US005104129A

United States Patent [19]

Hämäläinen et al.

[11] Patent Number: 5,104,129

Date of Patent: Apr. 14, 1992

[54] ARRANGEMENT FOR A GAME PLAYING DEVICE

[75] Inventors: Olli Hämäläinen, Espoo; Kauko Piri, Raivio, Evitskog, both of Finland

[73] Assignee: Raha-Automaattiyhdistys, Espoo, Finland

[21] Appl. No.: 613,587

[22] PCT Filed: Jun. 14, 1989

[86] PCT No.: PCT/F189/00113
§ 371 Date: Dec. 3, 1990
§ 102(e) Date: Dec. 3, 1990

[87] PCT Pub. No.: WO89/12876
PCT Pub. Date: Dec. 28, 1989

[30] Foreign Application Priority Data

Jun. 23, 1988 [FI] Finland ..... 883042

[51] Int. Cl.[5] ..... A63F 7/00

[52] U.S. Cl. ..... 273/371; 273/379; 273/399; 273/138 A

[58] Field of Search ..... 273/138 A, 138 R, 143 R, 273/355, 371, 379, 399

[56] References Cited

U.S. PATENT DOCUMENTS 4,496,160 1/1985 Wichinsky et al. ..... 273/138 A
4,844,464 7/1989 Berge ..... 273/138 A
5,016,880 5/1991 Berge ..... 273/138 A

*Primary Examiner*—Benjamin Layno
*Attorney, Agent, or Firm*—Nixon & Vanderhye

[57] ABSTRACT

An arrangement for a game playing device comprising a game playing apparatus which controls a prize delivering machinery (10), a feeding device (7) for a token (8) for starting the game playing apparatus against a payment, and a tuner (11) controlling the prize delivering machinery. The tuner improves the odds and the chances of winning a prize from a normal state in response to the operation of the game playing apparatus. In order that the tuner could be restored to the normal state by the player, the game playing device comprises a stop switch (13) which influences the feeding device for starting the game playing apparatus without payment and which is arranged to control the tuner in such a manner that the tuner is restored to the normal state when the operation of the game playing device does not affect the tuner or the prize delivering machinery, so that the player does not win a prize.

5 Claims, 2 Drawing Sheets

ARRANGEMENT FOR A GAME PLAYING DEVICE

Figure 1:
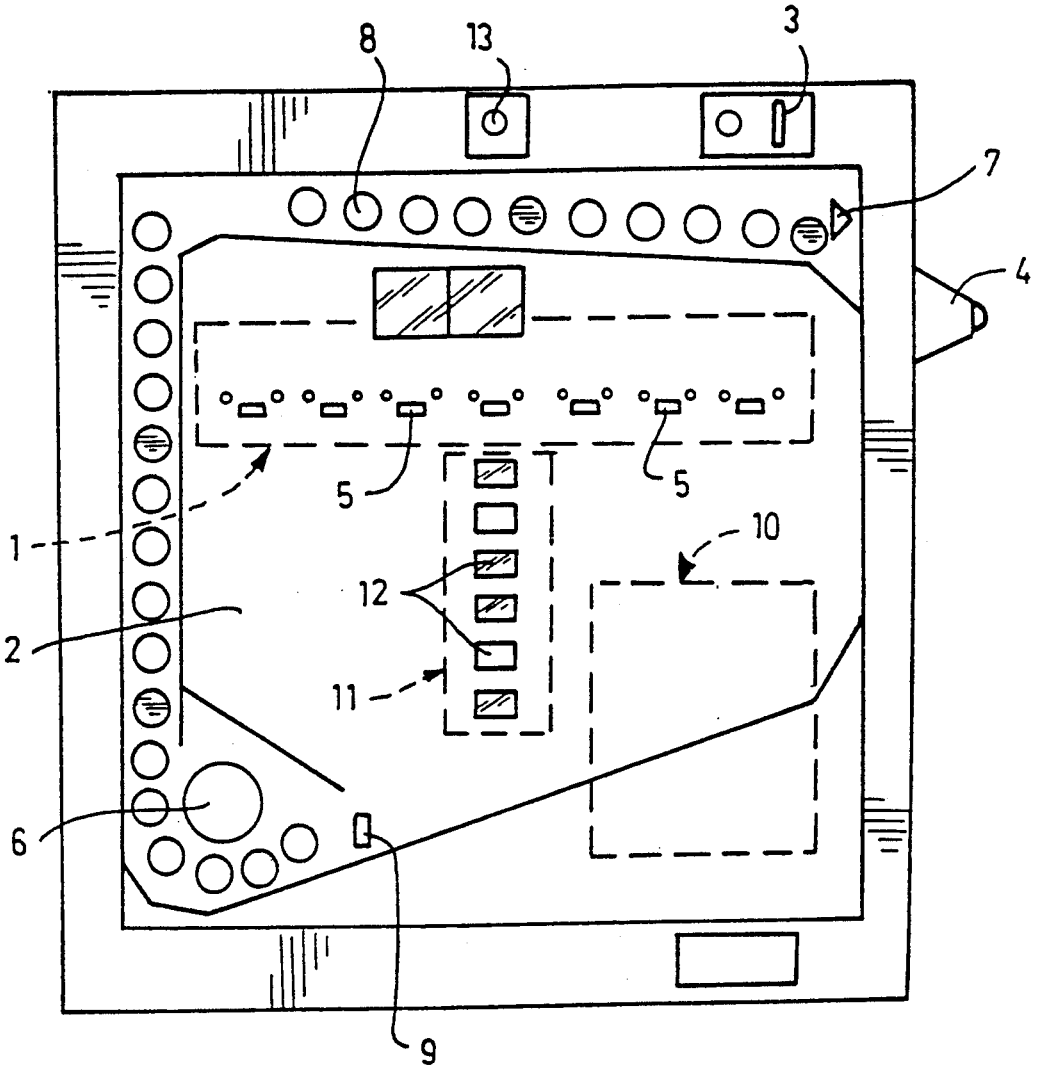

This invention relates to an arrangement for a game playing device comprising a game playing apparatus;

a prize delivering machinery controlled by the game playing apparatus;

a feeding device for a token for starting the game playing apparatus; and a tuning means controlling the prize delivering apparatus so that the odds and/or the chances of winning a prize are improved from a normal state in response to the operation of the game playing apparatus.

There is a great variety of prior art game playing devices in which the player can start the game playing apparatus with a coin or the like token usually in order to play the game once. The game playing apparatus may be a conventional slot machine, in which the player launches a coin into the play panel, trying to pass it through winning ports, or a display game known as a fruit game, in which the object is to make rotating drums stop in a position such that the drums together form a predetermined pattern.

In order to make the playing apparatuses more interesting and attractive, it is known to add tuning means to the game playing devices for temporarily increasing the amount to be paid out, or extra prizes or bonuses can be connected to the game. The operation of the tuning means may be controlled solely by the game playing apparatus, or the tuning means may be such as to allow the player himself to influence its operation. In a slot machine, for instance, the tuning means may be arranged to give extra prizes or to improve the odds in proportion as the coin passes through one or more prize-winning ports, so that the player gets an extra prize or bonus after the coin has passed through such a prize-winning port a predetermined number of times. In display games, the tuning means may be arranged to influence the rotation of the wheels so that the player is able to lock one or more wheels in advance in a certain position in order to increase the chances of winning a prize. After the achievement of the tuning state required by the tuning means, the tuning means is released, thus giving the player the advantage offered by the tuning state, whereafter the tuning means is restored to the normal state for the next tuning.

In game playing devices comprising this kind of tuning means, it is possible that the player does not manage to get the advantageous tuning state released, when he, for instance, runs out of coins or wishes to stop the playing for some other reason before he has been able to benefit from the improved odds or other advantages offered by the tuning state. The tuning state will thereby benefit the next player, who has not deserved it. It is also possible that when the player goes to exchange coins, somebody else starts to play the game and manages to get the tuning state released to the preceding player's disadvantage.

The object of the present invention is to provide a game playing device which avoids the abovementioned drawback and in which the player can restore the tuning means to the normal state. This object is achieved by means of a game playing device according to the invention, which is characterized in that the game playing device comprises a stop switch influencing the feeding device for starting the game playing apparatus; and that the stop switch is arranged to control the tuning means in such a manner that the tuning means is restored to the normal state when the game playing apparatus does not influence the tuning means or the prize delivering machinery.

The invention is based on the idea that the player is given still another opportunity to try to release the tuning state or to benefit from an advantageous tuning state without payment, whereby he simultaneously restores the tuning means to the normal state when he does not win in the game. In this way, the player is inveigled to restore the tuning means to the normal state himself. As a reward, he gets a free game and still another opportunity to benefit from the tuning state of the game. The player can, of course, press the stop switch whenever he wants and play the free game and benefit from the advantages possibly offered by the prevailing tuning state. Thereafter he may continue either from the normal state of the tuning means or after having won a prize from the respective tuning state. In this way, the game is considerably more interesting as it is ensured that the player need not leave any undeserved benefit to the next player, if he does not want to.

Figure 2:
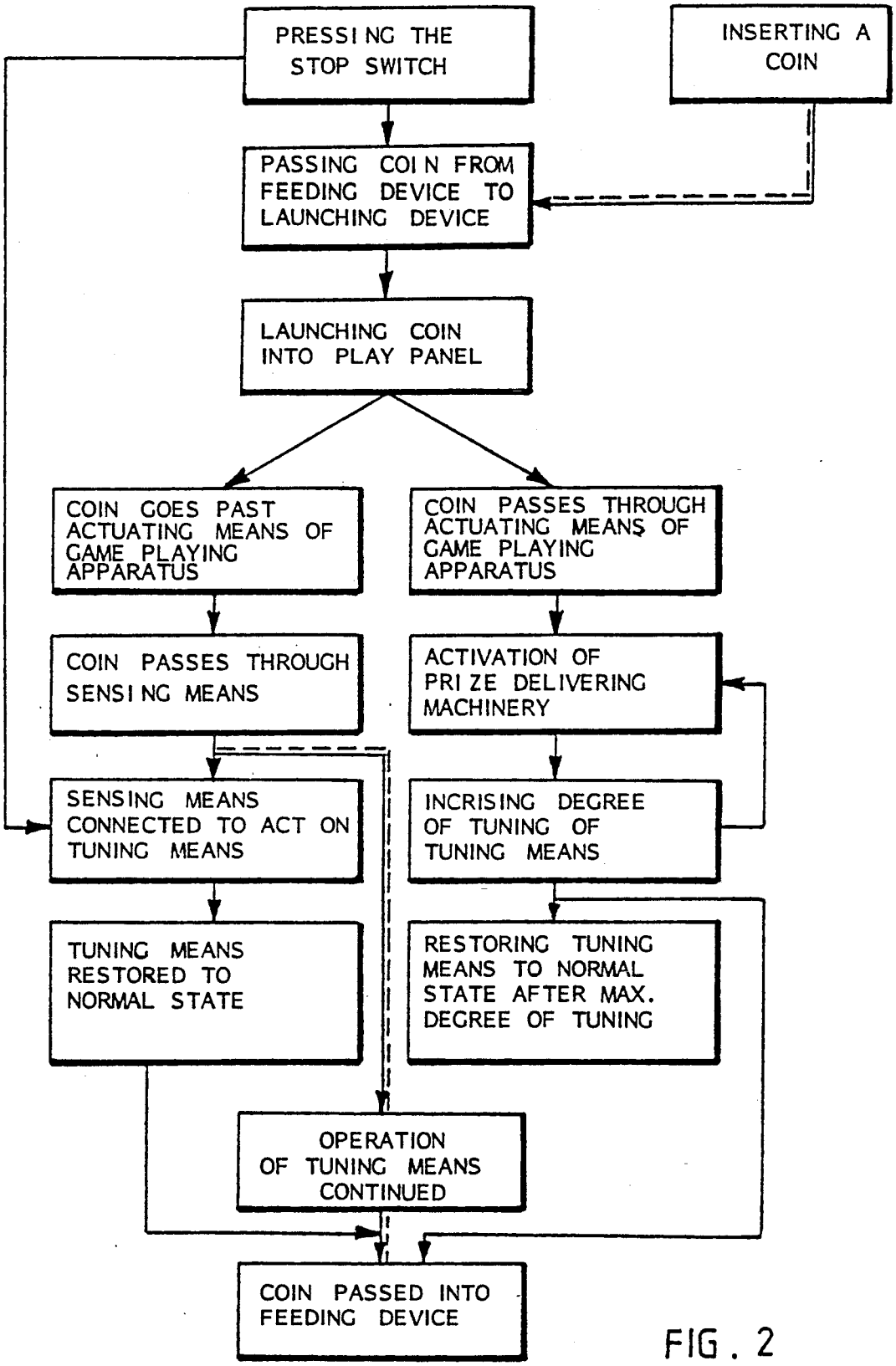

The invention will be described in greater detail in the following with reference to the attached drawing, wherein FIG. 1 is a front view of a slot machine in which the arrangement according to the invention is applied; and FIG. 2 shows a block diagram of the operation of the arrangement.

The game playing device shown in FIG. 1 of the drawing comprises a slot machine 1 comprising a play panel 2, a coin insert 3, a coin launching device 4, actuating means 5 detecting the passing of a coin therethrough, a coin insert device 6, a feeding device 7 for passing a coin 8 into the launching device, a sensing means 9 for detecting the descending of the coin. A game playing device of this type is described in the Applicant's U.S. Pat. No. 4,487,414, the disclosure of which is hereby incorporated by reference herein.

When playing the game, the player tries to launch a coin from the launching device so that it passes through one of the actuating means in the play panel, whereby he wins a prize associated with each particular actuating means. For this purpose, the game playing device further comprises a prize delivering machinery 10 shown only schematically. The actuating means control the prize delivering machinery only when a coin passes through one of the actuating means, whereas no prize is delivered when the coin goes past the actuating means or drops down between them.

The game playing device further comprises a tuning means 11 which in this particular case is represented by six prize increasing lamps 12. The tuning means may operate in such a manner that whenever a coin passes through one of the actuating means, one of the lamps is lit, and after all the lamps have been lit, the player gets an extra prize. Alternatively, the operation may be such that when the coin passes through a predetermined actuating means, such as the middlemost actuating means, one of the lamps is lit to indicate improved odds. When the coin passes through said one of the actuating means, the prize won by the player is the higher the greater the number of the lit lamps is. This makes the player more eager to go on with the game. After all the lamps have been lit, and the player manages to pass a coin through one of the actuating means, the tuning means is restored to its normal state, and the lamps go out.

According to the invention, the game playing device is provided with a press-button type stop switch means 13 which is connected to control the operation of the coin feeding device 7 so that the feeding machinery allows one coin in a sequence of coins to pass into the launching device 4 when the stop switch is pressed. The stop switch is also connected to influence the operation of the tuning means so that the tuning means 11 is restored to its normal state (e.g., all the lamps 12 have gone out), if said coin, when launched from the launching device, passes between the actuating means 5, that is, does not lead to any kind of prize or advantage. If the coin, instead, passes through one of the actuating means, the stop switch means 13 does not any longer influence the tuning means, so that the tuning means operates normally. Such an operation can be achieved by the coaction of the sensing means 9 sensing the descending of the coins and the actuating means 5. The stop switch means 13 is thereby connected to activate the sensing means so that it applies an impulse to the tuning means in order to restore it to its normal state if no impulse "cancelling" the restoration is received at the tuning means from any one of the actuating means.

Accordingly, the player gets a free game (coin) by pressing the stop switch means 13 whereafter the tuning means is restored to the normal state without affecting the prize delivering machinery if the coin does not pass through any one of the actuating means, or continues its operation according to its programme if the coin passes through one of the actuating means. In the former case, the player can continue the game normally or, if he wishes, press again the stop switch means 13 so as to get another free game. FIG. 2 is a block diagram showing the operation of the invention. The reference numerals in FIG. 2 indicate the corresponding structure of FIG. 1 which is utilized in the implementation of the particular operational steps illustrated. The press-button switch means 13 is connected electrically with the coin feeding device 7 to send a signal A to the coin feeding device 7 when the button 13 is pressed. This signal causes the coin feeding device to release one coin into the launching device 4. The sensing means 9 is electrically connected with the tuning device 11 to send a signal B to the tuning device when the sensing means 9 is actuated by a coin. The button 13 is electrically connected to also send a signal C, which allows the signal B from the sensing means 9 to reach the tuning means 11, e.g. by closing a switch. The actuating means 5 are electrically connected to send a signal D, which prevents the signal B from the sensing means reaching the tuning means, e.g. by opening a switch.

The drawing and the description related thereto are only intended to illustrate the idea of the invention. In its details, the arrangement according to the invention may vary within the scope of the claims. Accordingly, the arrangement can be applied to game playing apparatuses of some other type as well, such as so called fruit games, whereby the stop switch gives the player a free game (rotation of wheels) when he wants to stop playing the game. The stop switch is thereby connected to release all locked wheel-locking press buttons, if the free game does not result in such positions of the wheels that the combination of symbols so obtained would give a prize or other advantage.

We claim:

1. A game playing device assembly comprising: a game playing apparatus; a prize delivering machinery controlled by the game playing apparatus; a feeding device for a token for starting the game playing apparatus; tuning means for controlling the prize delivering apparatus so that the odds and/or the chances of winning a prize are improved from a normal state in response to the operation of the game playing apparatus; and stop switch means for influencing the feeding device for starting the game playing apparatus and for controlling the tuning means in such a way that the tuning means are restored to the normal state when the game playing apparatus does not influence the tuning means or the prize delivering machinery.

2. An assembly according to claim 1, wherein the game playing apparatus comprises: a play panel defining an area of movement for tokens, and comprising actuating means disposed in the area of movement and detecting the passing of tokens therethrough; and a launching device at the side of the area of movement for launching the tokens into the area of movement, so that the actuating means controls the tuning means; and wherein the stop switch means comprises means for feeding a token into the launching device and for restoring the tuning means to the normal state after said token has gone past the actuating means without passing through any one of them.

3. An assembly according to claim 2, wherein the stop switch means is connected to the feeding device and comprises means for passing a single token into the launching device when the stop switch means is activated.

4. An arrangement according to claim 3, wherein a sensing means for sensing the descending of tokens is disposed in the play panel below the actuating means so that the actuating means detection of the passing of a coin therethrough and the sensing means sensing of the descending of the coin influence the tuning means so that the activation of the stop switch means causes the tuning means to be restored to the normal state when only the sensing means influences the tuning means after the token fed by the stop switch means has passed through the sensing means.

5. An arrangement according to claim 2, wherein a sensing means for sensing the descending of tokens is disposed in the play panel below the actuating means so that the actuating means detection of the passing of a coin therethrough and the sensing means sensing of the descending of the coin influence the tuning means so that the activation of the stop switch means causes the tuning means to be restored to the normal state when only the sensing means influences the tuning means after the token fed by the stop switch means has passed through the sensing means.

* * * * *